US006336389B1

(12) United States Patent
English et al.

(10) Patent No.: US 6,336,389 B1
(45) Date of Patent: Jan. 8, 2002

(54) HIGH-PRESSURE PNEUMATIC AND LIQUID INJECTION APPARATUS

(75) Inventors: Rodney Ralph English, Sylvan Lake; Glendon Elmer English, Red Deer, both of (CA)

(73) Assignee: Envirodrive Inc., Red Deer (CA)

( * ) Notice: Subject to any disclaimer, the term of this patent is extended or adjusted under 35 U.S.C. 154(b) by 0 days.

(21) Appl. No.: 09/598,917

(22) Filed: Jun. 22, 2000

Related U.S. Application Data

(60) Provisional application No. 60/140,904, filed on Jun. 23, 1999.

(51) Int. Cl.[7] ..... F15B 21/04; F01L 31/00; F01B 9/00

(52) U.S. Cl. ..... 91/4 R; 91/354; 92/137

(58) Field of Search ..... 91/350, 354, 4 R; 92/137, 132

(56) References Cited

U.S. PATENT DOCUMENTS 375,761 A * 1/1888 McKim ..... 91/4 R

* cited by examiner

*Primary Examiner*—Thomas Denion
*Assistant Examiner*—Michael Leslie
(74) *Attorney, Agent, or Firm*—Miller Thomson LLP

(57) ABSTRACT

A pressurized working environment for a pneumatic device which permits emission-free utilization of the potential mechanical energy of pressure differentials within compressed gas systems is disclosed. The pneumatic device is contained within a pressure vessel and the pneumatic device exhaust is in fluid communication with the interior of the pressure vessel. In use, the interior of the pressure vessel is in fluid communication with an area of lower pressure in the compressed gas system and the pneumatic device intake is in fluid communication with an area of higher pressure in the compressed gas system. In use, the gas from the area of higher pressure drives the pneumatic device and is then exhausted to the area of lower pressure.

15 Claims, 9 Drawing Sheets

HIGH-PRESSURE PNEUMATIC AND LIQUID INJECTION APPARATUS

This application claims the benefit of U.S. Provisional Application No. 60/140,904, filed Jun. 23, 1999.

FIELD OF THE INVENTION

The present invention relates to compressed gas in situations where, in utilizing the potential energy of the compressed gas through pneumatic devices, it is preferable to recover the gas exhausted from the pneumatic device, including, but not limited to, natural gas production facilities and wells. The present invention also relates to the injection of liquids into compressed gas.

BACKGROUND OF THE INVENTION

In many situations it is necessary to utilize the potential energy of a compressed gas to power pneumatic devices so as to drive equipment. Pneumatic devices are devices which operate by converting the potential mechanical energy of a compressed gas into motion. Pneumatic devices utilize the tendency of gases to flow from an area of higher pressure to an area of lower pressure and therefore they require a pressure differential in order to operate. Typically, this pressure differential is between the exterior of the pneumatic device, typically the atmosphere, and a supply of gas at a higher than atmospheric pressure, which is fed into the interior of some of the components of the pneumatic device.

In general terms, the components of a pneumatic device may be divided into pressure differential components and non-pressure differential components. The pressure differential components are those components of a pneumatic device which face a pressure differential between their interiors and exteriors during normal operation. Examples of pressure differential components include: pipes and other forms of gas conduits; pneumatic cylinders; and valves. Non-pressure differential components are those components of a pneumatic device which do not face a pressure differential between their interiors and exteriors during normal operation. Examples of non-pressure differential components include: power output means such as shafts; and switch linkages.

In natural gas production facilities, it is often necessary to periodically or continually inject liquids into a high pressure gas pipeline. An example is methanol, which may be injected to prevent any water present in the natural gas from freezing. Such liquids are injected by means of pumps which overcome the pressure of the compressed gas to force the liquid into the pipeline. These injection pumps are often powered by pneumatic devices, particularly in remote locations. In some situations, the compressed gas flowing in the pipeline is used to drive the pump, but typically, only after it has been regulated down to a pressure suitable for the pneumatic device, often around 10 pounds per square inch. The exhaust gas from the pneumatic device comes out of the device at a lower pressure than the gas in the pipeline, so it can't be reinjected into the pipeline unless it is first compressed. Therefore the exhaust gas is usually vented to atmosphere. In some situations a gas such as propane is brought to the site, stored in a pressure vessel, and used to drive a pneumatic device. This gas is also vented to atmosphere from the pneumatic device.

This venting of the exhaust gas to atmosphere is a problem because it is a waste of valuable gas and because it raises environmental concerns, particularly in the case of sour gas. A means of utilizing the potential energy of the compressed gas, and of injecting liquids into a high pressure gas pipeline, which does not require venting of the gas is required.

BRIEF SUMMARY OF THE INVENTION

In accordance with the invention, it is found in using pneumatic devices that pressurizing the work environment of a variety of pneumatic devices and containers to the same pressure as the compressed gas with which the devices and containers are associated produces many benefits, including, but not limited to, the emission-free operation of pneumatic devices and the efficient injection of liquids into compressed gases.

In accordance with the invention, if a pressure differential exists within a compressed gas system, in a natural gas pipeline for example, and the working environment of the pneumatic device is pressurized by means of direct contact with that compressed gas in the compressed gas system which is at the lower pressure, and the pneumatic device is driven by compressed gas from that portion of the compressed gas system which is at the higher pressure, then the pneumatic device can operate so as to exhaust gas back into the compressed gas system; and the pressure differential components of the pneumatic device will face a maximum pressure differential between their interiors and exteriors equal to the pressure differential within the compressed gas system, rather than the pressure differential between the compressed gas system and the atmosphere.

Natural gas often comes out of the well at a high pressure, for example, 1,000 pounds per square inch. The natural gas often undergoes some processing immediately downstream of the well, for example, water is often removed by running the gas through a dehydrator. A usual side effect of this processing is that it lowers the pressure of the gas downstream of the processing equipment relative to the pressure upstream of the processing equipment, typically by constricting the flow of the gas. Therefore, there is usually a pressure differential between the gas upstream of the processing equipment and the gas downstream of the processing equipment. In situations where there is no processing equipment, a similar pressure differential can be created merely by constricting the flow of the gas.

One embodiment of this invention receives gas from the upstream, higher pressure side of the processing equipment, uses it to power a pneumatic device and then exhausts the gas at a pressure high enough so that the gas can be reinjected at the downstream, lower pressure side of the processing equipment.

A feature of this invention is a pressure vessel strong enough to withstand the highest pressure found in the compressed gas system to which the pressure vessel is attached. The pressure vessel contains some or all of the pressure differential components of a pneumatic device, whereby, although the device operates at a high ambient pressure, such as 1,000 pounds per square inch, the differential pressure faced by the bodies and seals of the various components (not including those seals between the exterior and interior of the pressure vessel) is low, such as 25 to 30 pounds per square inch.

The pneumatic drive unit or pneumatic device can be any device that operates by converting the potential mechanical energy of a compressed gas into motion.

In one embodiment of this invention, the pressure vessel contains a valve means connected by suitable conduit to the relatively higher pressure compressed gas in the pipeline; to a pneumatic cylinder; and to the interior of the pressure vessel, such that the valve means can be actuated to restrict the flow of gas between two of the three conduits connected to the valve means, being between the conduit to the relatively higher pressure compressed gas in the pipeline and the conduit to the pneumatic cylinder; and between the conduit to the pneumatic cylinder and the conduit to the interior of the pressure vessel. The interior of the pressure vessel is connected by suitable conduit to the relatively lower pressure compressed gas in the pipeline, wherein the pressure in the pressure vessel is essentially the same as the relatively lower pressure compressed gas in the pipeline. The pneumatic cylinder contains a piston. The piston in the pneumatic cylinder is connected to a spring which acts to move the piston so as to evacuate the compressed gas from the cylinder. The piston in the pneumatic cylinder is connected to a means for actuating the valve means such that when the piston is at the top of its stroke, being the position of its stroke where the compressed gas is substantially evacuated from the pneumatic cylinder, the valve means is actuated to permit the compressed gas to flow from the pipeline to the pneumatic cylinder, and such that when the piston is substantially at the bottom of its stroke, being the position of its stroke where the pneumatic cylinder is substantially full of compressed gas, the valve means is actuated to permit the compressed gas to flow from the pneumatic cylinder to the interior of the pressure vessel. When the valve means is actuated to permit the compressed gas to flow from the pipeline to the pneumatic cylinder, the pneumatic cylinder fills with compressed gas and the piston moves to the bottom of its stroke. When the pneumatic cylinder is substantially full of compressed gas and the piston is at the bottom of its stroke, the valve means is actuated to permit the compressed gas to flow from the pneumatic cylinder to the interior of the pressure vessel and the spring pulls the piston to the top of its stroke evacuating the compressed gas from the pneumatic cylinder to the interior of the pressure vessel and thence to the relatively lower pressure portion of the pipeline. In this way the piston is made to move in a reciprocating motion. The piston can be connected to a variety of mechanical devices such that the reciprocating motion of the piston is used to drive the mechanical device.

The movement created when the pneumatic device is actuated by the compressed gas can be transferred to the exterior of the pressure vessel by a variety of mechanical means, such as by a reciprocating shaft passing through the vessel wall, or by a rotating shaft passing through the vessel wall.

With a shaft passing through the pressure vessel wall where there is a high pressure differential between the inside and outside of the pressure vessel, a shaft making a rotary movement is easier to seal than a shaft making a reciprocating movement. A feature of this invention is a means of changing a reciprocating movement of a piston into an oscillating rotary movement. In one embodiment, the piston is attached to one end of a chain, the first chain. The other end of the first chain is attached to the circumferential edge of a wheel. The wheel is concentrically mounted on a shaft. The shaft is connected to the walls of the pressure vessel so that it can only move rotationally. A second chain is also attached to the circumferential edge of the wheel. The second chain is attached to a spring. As the pneumatic cylinder fills with compressed gas the piston moves from the top of its stroke to the bottom of its stroke and pulls on the first chain which causes the wheel to rotate. This rotation of the wheel pulls on the second chain which stretches the spring. When the piston reaches the bottom of its stroke the compressed gas in the pneumatic cylinder begins venting to the interior of the pressure vessel. The spring attached to the second chain causes the wheel to rotate in the reverse direction to its previous rotation, which acts to pull the piston to the top of its stroke. When the piston reaches the top of its stroke, the compressed gas ceases venting to the interior of the pressure vessel, compressed gas starts flowing into the pneumatic cylinder and the cycle repeats itself. In this way the reciprocating motion of the piston is converted to an oscillating rotary motion of the shaft. The oscillating rotary motion of the shaft can be used to drive a mechanical device such as a pump by way of a pitman or crank arm, or some other suitable device.

A feature of an embodiment of this invention is the submersion of the components in oil or some other suitable liquid, which provides lubrication, minimizes wear and prevents corrosion.

In one embodiment of this invention, part or all of the components of the equipment which is driven by the pneumatic device are contained within the pressure vessel. In one embodiment, the equipment is a pump, and part or all of the components of the pump are contained within the pressure vessel. In this embodiment of the invention, a seal between the interior and exterior of the pressure vessel for a moving shaft is not necessary.

In one embodiment of the invention, the valve means is connected by suitable conduit to: the relatively higher pressure portion of the compressed gas system; to the pneumatic cylinder; and to an exhaust area. The exhaust area is an area in fluid contact with the relatively lower pressure portion of the compressed gas system. The exhaust area may be within the interior of the pressure vessel. However, in some cases it is preferable for the exhaust area to be outside of the pressure vessel. For example, in some cases the compressed gas contains liquids which can tend to precipitate out of the compressed gas and to remain in the pressure vessel. This can be avoided by venting the exhaust gases outside of the pressure vessel. In one embodiment, the exhaust gas is vented within the conduit connecting the pressure vessel to the relatively lower pressure portion of the compressed gas system, in such a way that liquids will tend to flow away from the pressure vessel. In this embodiment, the valve means is such that it can be actuated to restrict the flow of gas to between two of the three conduits connected to the valve means, being: between the conduit to the relatively higher pressure portion of the compressed gas system and the conduit to the pneumatic cylinder; and between the conduit to the pneumatic cylinder and the conduit to the exhaust area.

In one embodiment, the piston in the pneumatic cylinder is connected to a piston biassing means, typically a spring, which causes the piston to tend to move so as to evacuate the compressed gas from the cylinder. The piston in the pneumatic cylinder is connected to a means for actuating the valve means such that when the piston is at top of stroke, being the position of its stroke where the gas is substantially evacuated from the pneumatic cylinder, the valve means is actuated to permit the gas to flow from the relatively higher pressure portion of the compressed gas system to the pneumatic cylinder, and such that when the piston is substantially at bottom of stroke, the valve means is actuated to permit the compressed gas to flow from the pneumatic cylinder to the exhaust area. When the piston is at bottom of stroke, the valve means is actuated to permit the compressed gas to flow from the pneumatic cylinder to the exhaust area; and the piston biassing means causes the piston to move to top of stroke, evacuating the compressed gas from the pneumatic cylinder to the exhaust area and thence to the relatively lower pressure portion of the compressed gas system.

In one embodiment, the piston is connected to one end of a piston chain. The other end of the chain is circumferentially attached to a drive sprocket. The drive sprocket is concentrically mounted on a rotatable shaft passing through the wall of the pressure vessel. One end of a second chain, the return chain, is mounted circumferentially on the drive sprocket in opposition to the piston chain. The other end of the return chain is attached to: the return spring; or some other biassing means which puts tension on the return chain. The links of the piston chain and return chain are configured so as to engage with the sprocket teeth which are positioned around the periphery of the drive sprocket.

In use, as the pneumatic cylinder fills with compressed gas the piston moves from top of stroke to bottom of stroke, and pulls on the piston chain which causes the drive sprocket to rotate and which stretches the chainspring. When the piston reaches bottom of stroke, the valve means is actuated to permit the compressed gas in the pneumatic cylinder to vent to the exhaust area. The piston biassing means causes the piston to move to top of stroke. This reduces the tension on the return spring. The return spring, through the return chain, causes the drive sprocket to rotate in the reverse direction to its previous rotation. When the piston reaches top of stroke, the compressed gas ceases venting to the exhaust area, compressed gas starts flowing into the pneumatic cylinder and the cycle repeats itself. In this way the reciprocating motion of the piston is converted to an oscillating rotary motion of the shaft.

It will be clear to those skilled in the art that a variety of means for transforming the oscillating motion of the piston into a rotary motion could be employed, including but not limited to: a rack and pinion, and a swash plate drive.

The oscillating rotary motion of the shaft may be used to drive a mechanical device by converting the motion to non-oscillating rotary motion by means of a ratchet slip clutch and a flywheel.

It will be clear to those skilled in the art that with some pneumatic devices it is possible to connect the interior of the pressure vessel to the area of higher pressure in the compressed gas system whereby the work environment within the pressure vessel is in fluid contact with the area of higher pressure. With this configuration, the exhaust of the pneumatic device is connected to the area of lower pressure in the compressed gas system and the intake of the pneumatic device is in fluid communication with the interior of the pressure vessel.

Typically, when the pneumatic apparatus is used with a natural gas pipeline system it is necessary to use a differential controller to create the required pressure differential. The pipeline system may have a pressure differential which is either too small to drive the pneumatic apparatus or too large for the components of the pneumatic device to withstand. Differential controllers can take many forms. Typically they have a means for sensing the pressure upstream and downstream of a valve, these sensors being connected to a means for opening and closing the valve, so that the valve opening is constricted when the pressure differential is less than desired and enlarged when the pressure differential is greater than desired. In natural gas pipeline systems where the pressure differential naturally occurring in the system is too small, the differential controller is installed in line in the pipeline to create the necessary pressure differential. By contrast, in natural gas pipeline systems where the pressure differential naturally occurring in the system is too large, the differential controller is installed in line in the conduit between the pipeline system and the pneumatic apparatus to reduce the existing pressure differential.

It is clear that the pneumatic apparatus will only function when there is a pressure differential. In most compressed gas systems this pressure differential arises because the gas is flowing. The pressure differential disappears when the gas ceases to flow, even though the compressed gas system is still pressurized. In some applications, such as where methanol is being injected into a pipeline to act as an antifreeze, it is preferable that the methanol injection stop while the gas is not flowing. In other applications, such as where the pneumatic apparatus is being used to pump heated glycol through heat tracing positioned around above-ground portions of a pipeline, it is preferable that the pump continue to operate even though the gas is not flowing. If it is necessary to keep the pneumatic device operating whether or not the gas is flowing the conduit connecting the interior of the pressure vessel to the compressed gas system can be fitted with a bypass to a differential controller and thence to atmosphere.

In another embodiment of this invention, related to pressurising the work environment, where it is necessary to inject a liquid into a compressed gas, in a natural gas pipeline for example, enclosing the liquid in a container in which the liquid is under the same pressure as the compressed gas, and locating that container so that the outlet for the liquid is higher than the location where the liquid is injected into the compressed gas, results in a gravity-induced flow of the liquid from the container into the compressed gas. The liquid in the vessel can be pressurized to the same pressure as the compressed gas by many means, including locating the liquid container in a larger high pressure vessel containing the compressed gas, or making the liquid container itself a high pressure vessel with sufficient connections to the compressed gas to keep the liquid at the same pressure as the compressed gas and to permit a controlled flow of the liquid into the compressed gas. The flow of liquid into the compressed gas may be controlled by way of a metering valve or other similar device. The level of the liquid can be monitored with a high-pressure level sight glass. Liquid can be added to the liquid container by a variety of means, including, a high pressure pump if it is necessary to maintain the liquid at the same pressure as the compressed gas, or by gravity or other simple means if it is possible to isolate the liquid container from the compressed gas and bleed it down to atmospheric pressure.

According to one aspect, the invention consists of a pneumatic apparatus for using the pressure differential between an area of higher pressure and an area of lower pressure in a compressed gas system to drive equipment, the pneumatic apparatus comprising:

(A) a pressure vessel;

(B) a gas outlet in the wall of the pressure vessel, said gas outlet being in fluid communication with the interior of the pressure vessel;

(C) a pneumatic device, a portion of said pneumatic device being located within the pressure vessel, and said pneumatic device including an intake and an exhaust, wherein when the pneumatic device is being pneumatically actuated, the gas used to drive the pneumatic device passes into the pneumatic device through the intake and the exhaust gas is exhausted through the exhaust; and (D) said pneumatic device exhaust being in fluid communication with the interior of the pressure vessel;

wherein if the gas outlet is connected by suitable conduit to the area of lower pressure whereby the interior of the pressure vessel is in fluid contact with the area of lower pressure and the pneumatic device intake is connected by suitable conduit to the area of higher pressure whereby the pneumatic device intake is in fluid contact with the area of higher pressure, then exhaust gas from the pneumatic device can flow to the area of lower pressure.

A portion of the equipment driven by the pneumatic apparatus may be located within the pressure vessel. The equipment driven by the pneumatic apparatus may be located outside the pressure vessel.

The pneumatic device may comprise:

(A) a pneumatic cylinder;

(B) a piston within the pneumatic cylinder, said piston defining a chamber with the pneumatic cylinder, said chamber changing in size as the piston moves within the pneumatic cylinder;

(C) a piston biassing means connected to the piston and causing the piston to tend to move to, and remain at, top of stroke, being the position of the piston where the chamber is the smallest;

(D) a three-port Y valve, wherein one port is connected by conduit to the chamber; one port is the pneumatic device intake and one port is the pneumatic device exhaust;

(E) a valve switch incorporated in the Y valve wherein when the valve switch is at a first position, gas can flow through the Y valve between the intake and the chamber, and when the valve switch is at a second position gas can flow through the Y valve between the chamber and the exhaust; and (F) a linkage connecting the piston to the valve switch, wherein when the piston is substantially at top of stroke the valve switch is at the first position and when the piston is substantially at bottom of stroke the valve switch is at the second position, whereby when the piston is at top of stroke, gas can flow from the intake to the chamber and when the piston is at bottom of stroke, gas can flow from the chamber to the exhaust.

The linkage may comprise:

(A) a rotatable member;

(B) a flexible member connected to the piston and attached to the rotatable member, whereby movement of the piston in the direction from top of stroke to bottom of stroke will cause the rotatable member to rotate in one direction;

(C) a rotatable member biassing means connected to the rotatable member and tending to cause the rotatable member to rotate in the opposite direction from that rotation caused by the movement of the piston in the direction from top of stroke to bottom of stroke;

(D) means for connecting the rotatable member to the valve switch.

The rotatable member may be attached to an output shaft. The output shaft may pass through the wall of the pressure vessel. The rotatable member may be a sprocket, said sprocket incorporating teeth, and the flexible member may be a chain, wherein the chain engages with the teeth. The rotatable member biassing means may comprise a spring, one end of the spring being connected to the drive sprocket. The means for connecting the rotatable member to the valve switch may comprise a switch spring.

The pressure vessel may contain a liquid. The liquid may be oil.

According to another aspect, the invention consists of a pneumatic apparatus for using the pressure differential between an area of higher pressure and an area of lower pressure in a compressed gas system to drive equipment, the pneumatic apparatus comprising:

(A) a pressure vessel; and (B) a pneumatic device, a portion of said pneumatic device being located within the pressure vessel, and said pneumatic device incorporating an intake and an exhaust, wherein when the pneumatic device is being pneumatically actuated, the gas used to drive the pneumatic device passes into the pneumatic device through the intake and the exhaust gas is exhausted through the exhaust, wherein if the pneumatic device exhaust is in fluid communication with the area of lower pressure and the pneumatic device intake is in fluid communication with the area of higher pressure, then exhaust gas from the pneumatic device can flow to the area of lower pressure.

The interior of the pressure vessel may be in fluid communication with the pneumatic device exhaust. The interior of the pressure vessel may be in fluid communication with the pneumatic device intake.

According to another aspect, the invention consists of a liquid injection apparatus for use with a compressed gas system comprising:

(A) a liquid container connected to the compressed gas system such that the interior of the liquid container is in fluid communication with the compressed gas system; and (B) a conduit connecting the liquid container to an injection point on the compressed gas system, wherein liquid can flow from the liquid container to the injection point.

The liquid injection apparatus may also comprise a pressure vessel, wherein: the liquid container is located within the pressure vessel, the interior of the liquid container is in fluid communication with the interior of the pressure vessel and the interior of the pressure vessel is in fluid communication with the compressed gas system. The liquid container may be located higher than the injection point on the compressed gas system.

The various features of novelty which characterize the invention are pointed out with more particularity in the claims annexed to and forming a part of the disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DETAILED DESCRIPTION OF THE INVENTION

Figure 1:
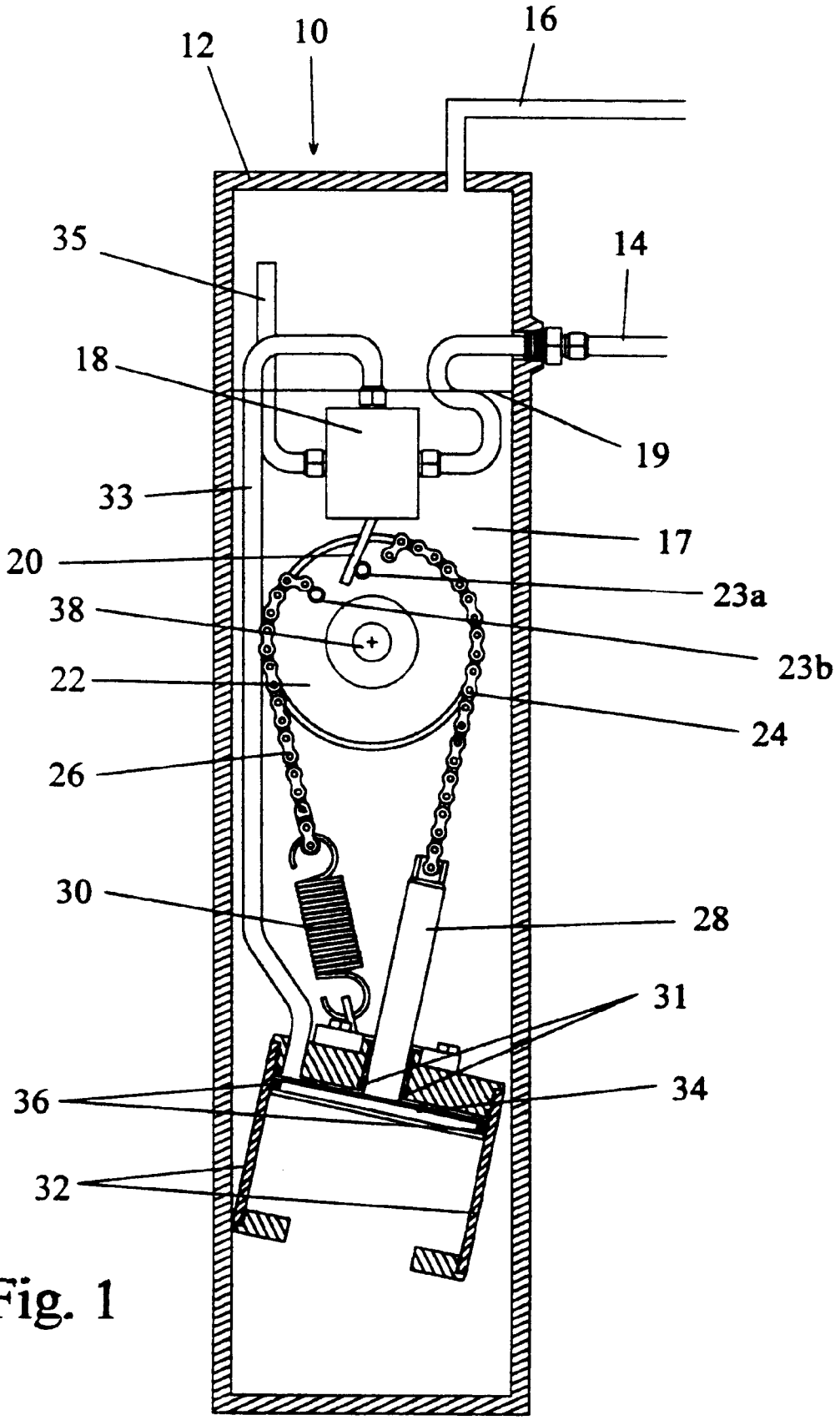
FIG. 1 is an elevation view of the pneumatic apparatus with external drive with parts of the pressure vessel wall and the pneumatic cylinder cut away, showing the piston at the top of its stroke.
Figure 2:
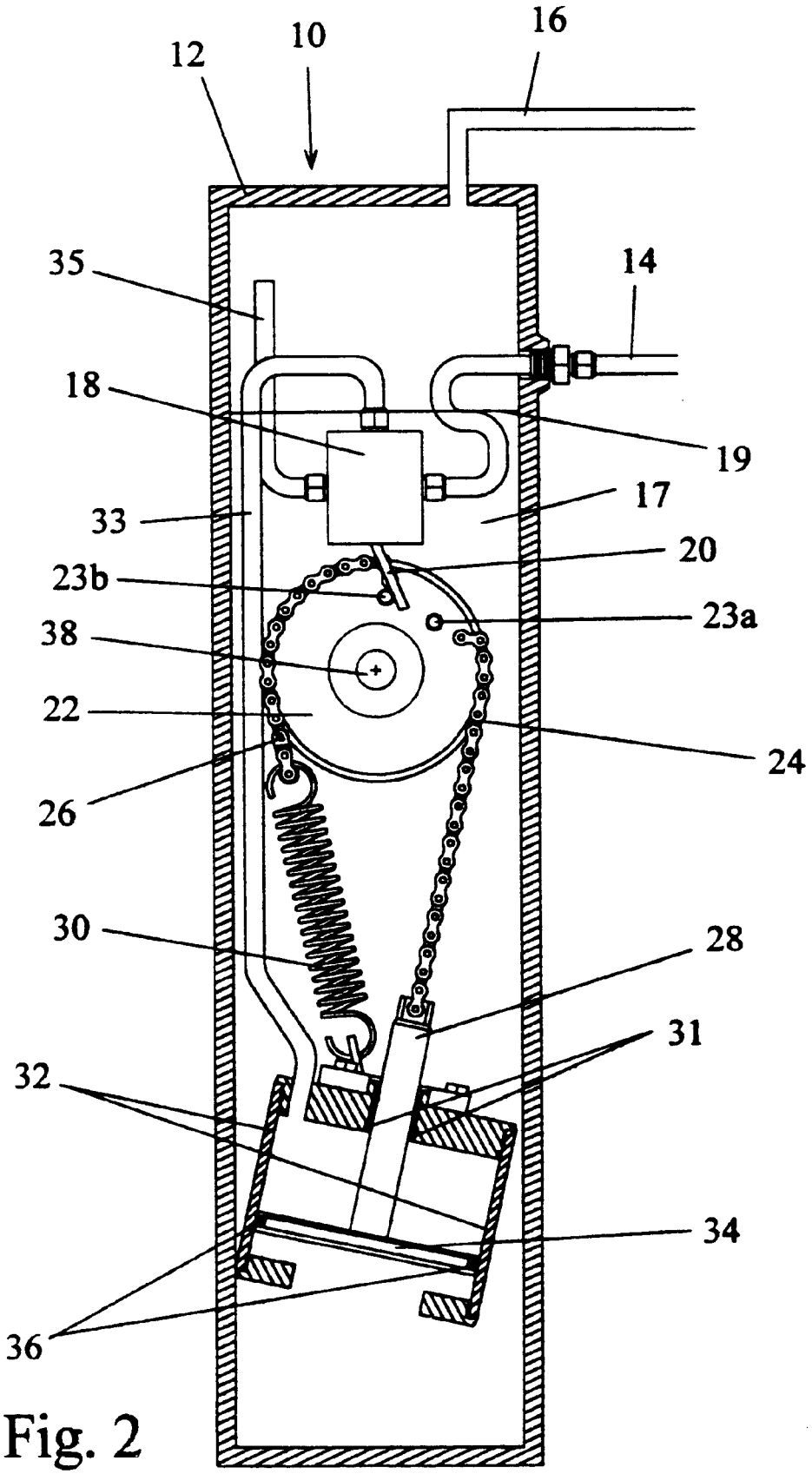
FIG. 2 is an elevation view of the pneumatic apparatus with external drive, with parts of the pressure vessel wall and the pneumatic cylinder cut away, showing the piston at the bottom of its stroke.

Referring to FIGS. 1 and 2, a pneumatic apparatus with external drive (10) is shown comprising a pressure vessel (12) connected to the compressed gas outlet (16) and containing several components. One of the components is a pneumatic cylinder (32) containing a piston (34) which is connected to the piston shaft (28). The piston shaft (28) is connected to one end of the piston shaft chain (24). The other end of the piston shaft chain (24) is circumferentially attached to the wheel (22) and some additional portion of the piston shaft chain (24) is in contact with the edge of the wheel (22) such that movement of the piston shaft (28) away from the wheel (22) will cause the wheel (22) to rotate. The wheel (22) is concentrically attached to the output shaft (38). The Y valve switch operators (23*a* and 23*b*) are attached to the side of the wheel (22). One end of the spring chain (26) is circumferentially attached to the wheel (22). The other end of the spring chain (26) is attached to the spring (30) and some additional portion of the spring chain (26) is in contact with the edge of the wheel (22) such that movement of the part of the spring (28) connected to the spring chain (26) away from the wheel (22) will cause the wheel (22) to rotate. The Y valve (18) is positioned adjacent to the wheel (22) such that the Y valve switch operators (23) contact the Y valve switch (20) when the wheel (22) rotates. The Y valve is connected to the compressed gas inlet (14), the valve to cylinder conduit (33) and the valve to interior conduit (35).

The pressure vessel (12) is filled with sufficient oil (17) such that substantially all of the components contained in the pressure vessel (12) are below the top of oil (19) and are submerged in the oil (17). The piston seal (36) and piston shaft seal (31) act to exclude the oil (17) from the pneumatic cylinder (32).

The compressed gas outlet (16) and the compressed gas inlet (14) are each connected to a point on a compressed gas system. The compressed gas system has pressure differentials within it. The compressed gas outlet (16) is connected to a point on the compressed gas system where the pressure is lower than the pressure at the point where the compressed gas inlet (14) is connected to the compressed gas system. The compressed gas outlet (16) is open to the interior of the pressure vessel (12) and therefore the interior of the pressure vessel (12) is at substantially the same pressure as the point on the compressed gas system where the compressed gas outlet (16) is connected.

Referring to FIG. 1, the piston (34) is at the top of its stroke and the wheel (22) is in a position whereby one of the Y valve switch operators (23*a*) is in contact with the Y valve switch (20). The Y valve switch (20) is in the position whereby the Y valve (18) is only open between the compressed gas inlet (14) and the valve to cylinder conduit (33), which permits a flow of compressed gas from the compressed gas inlet (14) to the valve to cylinder conduit (33) and thereby into the pneumatic cylinder (32). As the compressed gas flows into the pneumatic cylinder (32) the pressure on the compressed gas side of the piston (34) tends to exceed the pressure on the other side of the piston (34) generating a force against the piston (34). When that force exceeds the resistence of the spring (30), the spring begins to stretch and the piston (34) begins to move towards the bottom of its stroke.

When the piston (34) reaches the bottom of its stroke, FIG. 2, the wheel (22) has been rotated by the movement of the piston (34) through the connection with the piston chain (24) and piston shaft (28), such that the other Y valve switch operator (23*b*) contacts the Y valve switch (20) and moves the Y valve switch (20) so that the Y valve (18) is only open between the valve to interior conduit (35) and the valve to cylinder conduit (33), which permits a flow of compressed gas from the pneumatic cylinder (32), through the valve to cylinder conduit (33), through the valve to interior conduit (35) and into the interior of the pressure vessel, whereby the pressure within the pneumatic cylinder (32) drops to equalize with the pressure in the remainder of the interior of the pressure vessel (12). As the pressure in the pneumatic cylinder (32) drops, the force against the piston (34) decreases to a point where it is less than the resistence of the spring (30) imparted via the spring chain (26), wheel (22), piston chain (28) and piston shaft (28), and the piston (34) moves towards the top of its stroke. When the piston (34) reaches the top of its stroke, FIG. 1, a Y valve switch operator (23*a*) contacts and moves the Y valve switch (20) to the position whereby the Y valve (18) is only open between the compressed gas inlet (14) and the valve to cylinder conduit (33), and the piston (34) begins another stroke.

Figure 3:
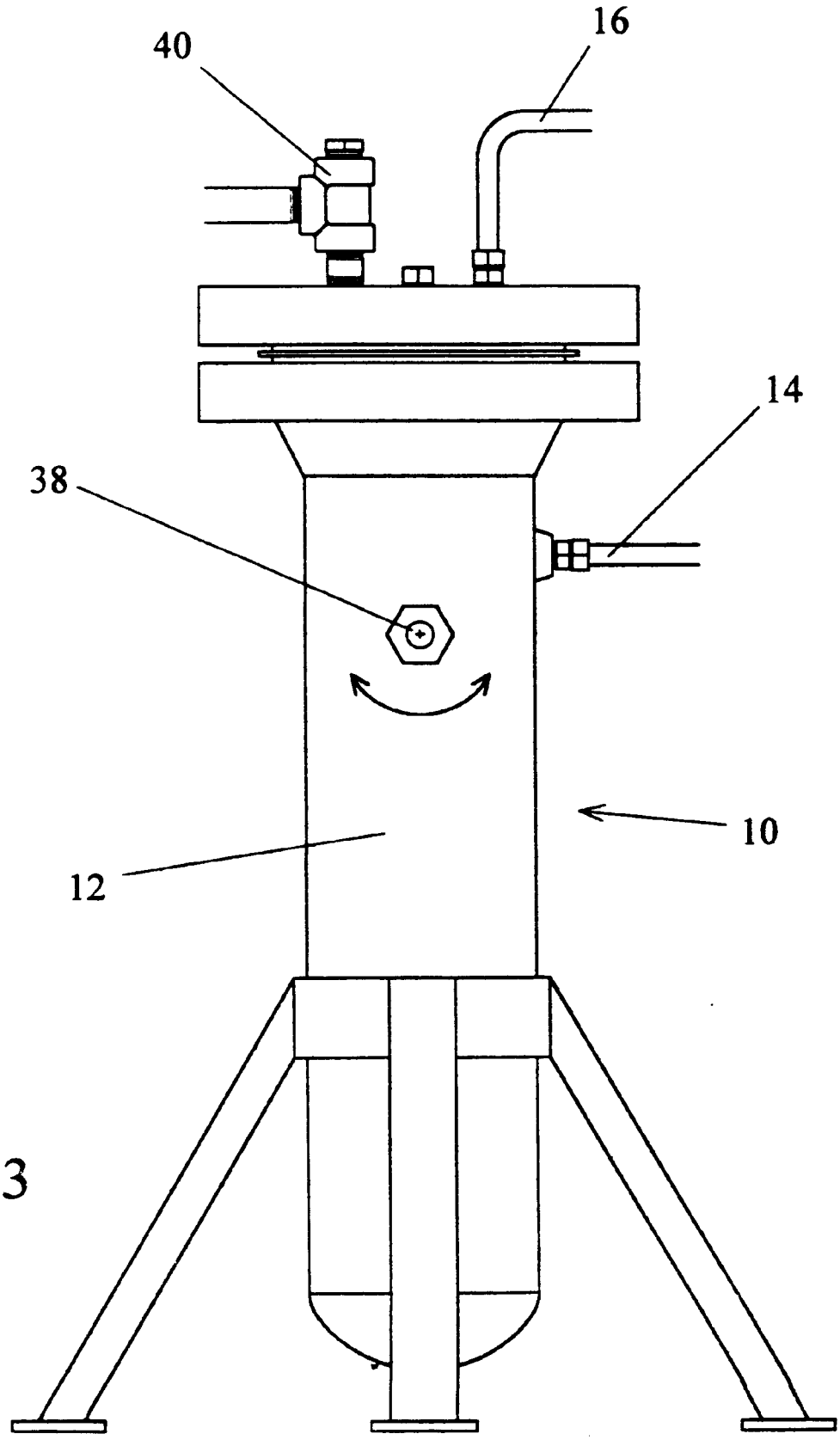
FIG. 3 is an external view of the pneumatic apparatus showing the external drive.

In this way, each cycle of the piston (34), from top of stroke, FIG. 1, to bottom of stroke, FIG. 2, and back again, FIG. 1, causes the wheel (22) to rotate first in one direction and then in the other direction. The wheel (22) is fixed to the output shaft (38). The output shaft (38) undergoes the same oscillating rotary motion as the wheel (22). The output shaft (38) projects through the wall of the pressure vessel (12), FIG. 3, and is sealed with a suitable seal (not shown). The output shaft (38) can be used to drive a variety of mechanical devices.

Figure 4:
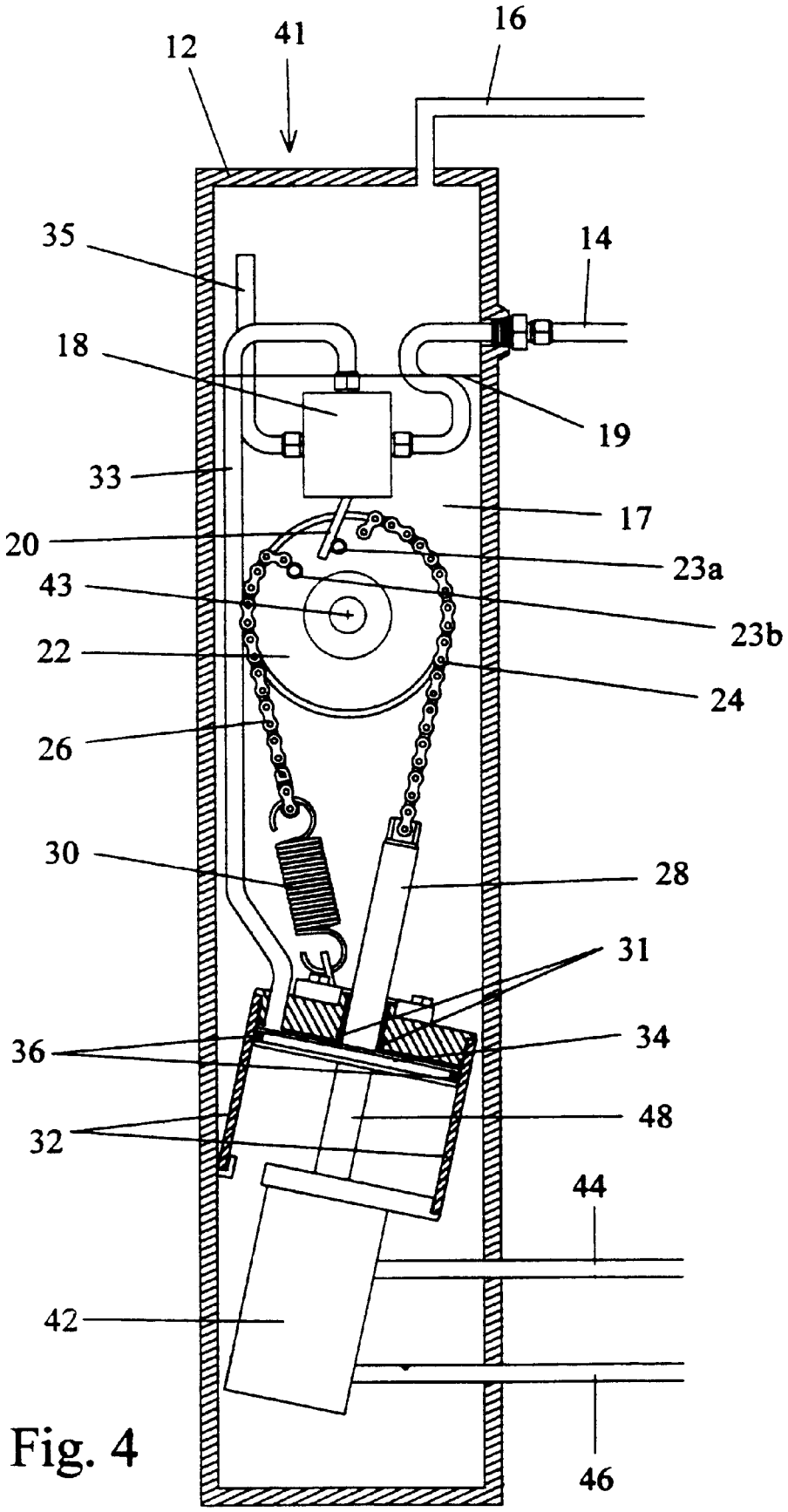
FIG. 4 is an elevation view of the pneumatic apparatus with internal pump, with parts of the pressure vessel wall and the pneumatic cylinder cut away, showing the piston at the top of its stroke.
Figure 5:
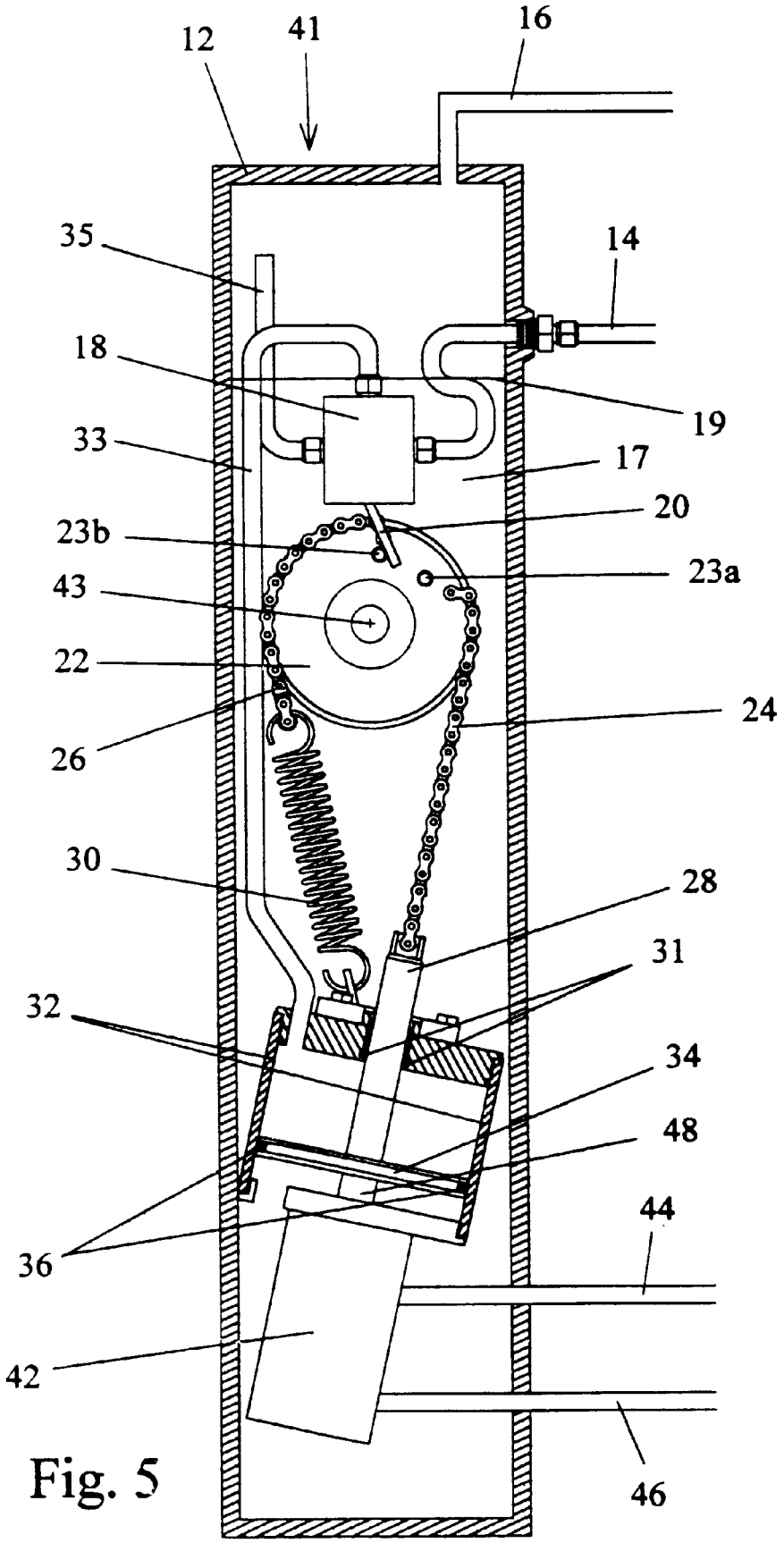
FIG. 5 is an elevation view of the pneumatic apparatus with internal pump, with parts of the pressure vessel wall and the pneumatic cylinder cut away, showing the piston at the bottom of its stroke.

Referring to FIGS. 4 and 5, a pneumatic apparatus with internal pump (41) is shown. An embodiment of the invention with a configuration of spring (30), spring chain (26), wheel (22), piston shaft chain (24) and piston shaft (28), which is similar to the previously described pneumatic apparatus with external drive, is shown. However, such a configuration is not essential to the invention. The invention can function with a variety of configurations comprising a pressure vessel; a pneumatic drive unit; a pump; and a means of connecting the pneumatic drive unit to the pump.

The pressure vessel (12) is filled with sufficient oil (17) such that substantially all of the components contained in the pressure vessel (12) are below the top of oil (19) and are submerged in the oil (17). The piston seal (36) and piston shaft seal (31) act to exclude the oil (17) from the pneumatic cylinder (32).

The embodiment of the invention shown in FIGS. 4 and 5, operates to create a reciprocating movement of the piston

(34) in the same manner as the previously described pneumatic apparatus with external drive, but it is different in that the wheel axis of rotation (43) is not necessarily an output shaft. The piston (34) is connected to the pump (42) by way of the pump drive shaft (48). The pump is connected to a liquid inlet (44) and a liquid outlet (46). The liquid inlet (44) and liquid outlet (46) pass through the wall of the pressure vessel (12). The liquid inlet (44) is connected to a supply of the liquid to be injected (not shown). The liquid outlet (46) is connected to whatever the liquid is being pumped to, for example a compressed gas system where the liquid is being injected (not shown).

The reciprocating movement of the piston (34) drives the pump (42), which pumps the liquid from the liquid inlet (44) to the liquid outlet (46).

Figure 6:
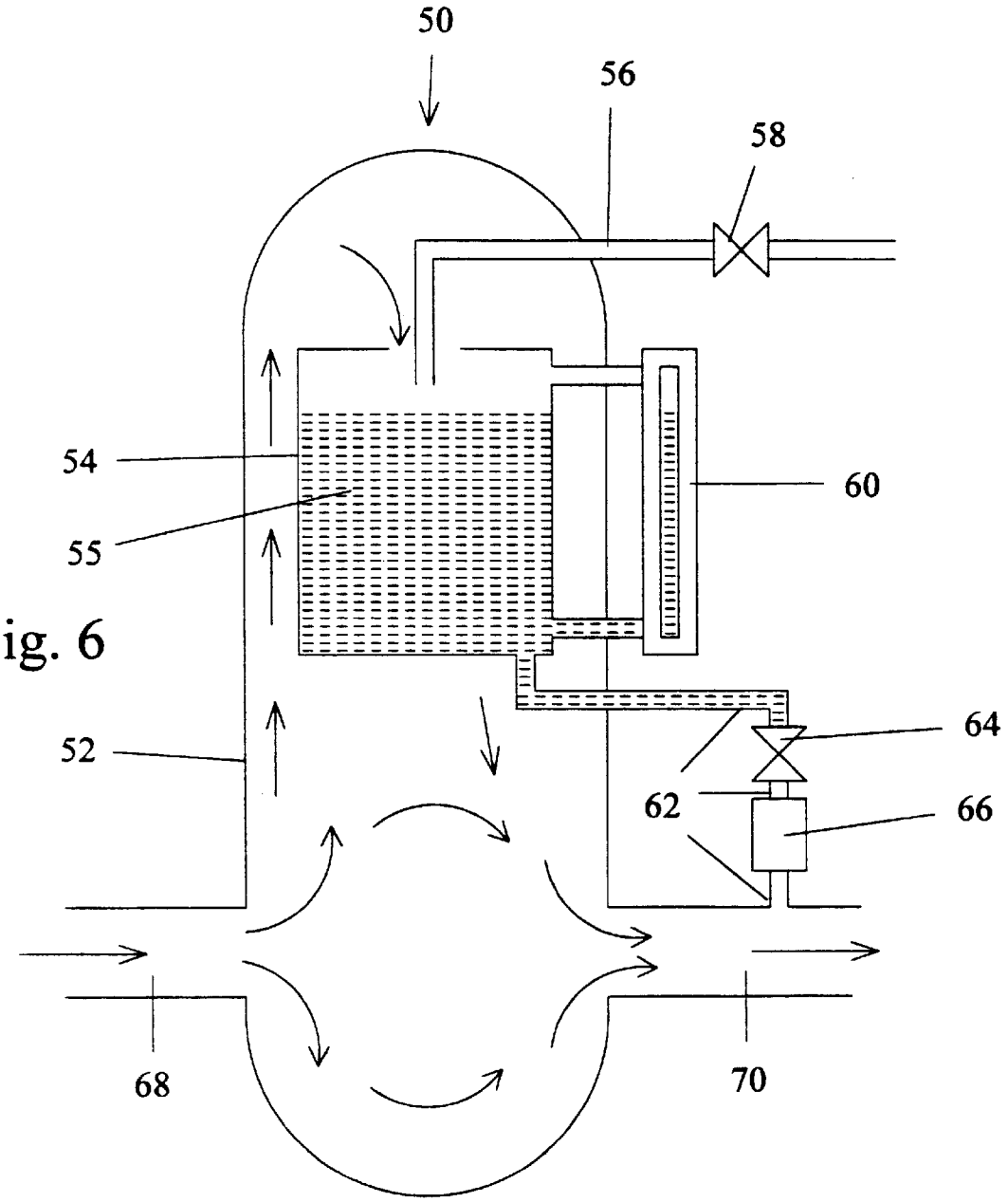
FIG. 6 is a schematic view of the liquid-injection apparatus.

Referring to FIG. 6, an embodiment of the liquid injection apparatus is shown. A gas processing pressure vessel (52) is connected to an upstream pipeline (68) and a downstream pipeline (70). The gas processing pressure vessel (52) can contain means for processing the gas within it (not shown), for example, it may be a dehydrator. The gas processing pressure vessel (52) contains the liquid container (54). The liquid container (54) contains a liquid (55). The liquid container (54) is connected to the liquid injection line (62). The liquid injection line passes through the wall of the gas processing pressure vessel and connects to the downstream pipeline (70). The metering valve (64) and the meter (66) are on the liquid injection line (62). The liquid fill line (56) passes through the wall of the gas processing pressure vessel and empties into the liquid container (54). The shut-off valve (58) is on the liquid fill line (56). The liquid container is connected by suitable conduit passing through the wall of the gas processing pressure vessel (52) to the level sight glass (62).

The liquid container (54) is filled with the liquid (55) by means of the liquid fill line (56). When filling is not taking place the shut-off valve (58) is closed so as to maintain the pressure of the compressed gas in the gas processing pressure vessel (52). It is apparent that there are many other means of filling the liquid container, such as through the liquid injection line (62) with the addition of a T fitting and valve (not shown). The level sight glass (60) or other suitable device can be used to monitor the level of the liquid (55) in the liquid container (54).

The interior of the liquid container (54) is exposed to the same pressure as the exterior of the liquid container (54) by suitable means. Therefore, the liquid (55) in the liquid container (54) is under the same pressure as the compressed gas flowing in the pipeline (68 and 70) and filling the gas processing pressure vessel (54). The liquid (55) in the liquid container (54) can flow by gravity into the liquid injection line (62) into the downstream pipeline (70). The metering valve (64) can be used to control the flow of liquid into the downstream pipeline (70). The meter (66) can be used to monitor the flow of liquid into the downstream pipeline (70).

Figure 7:
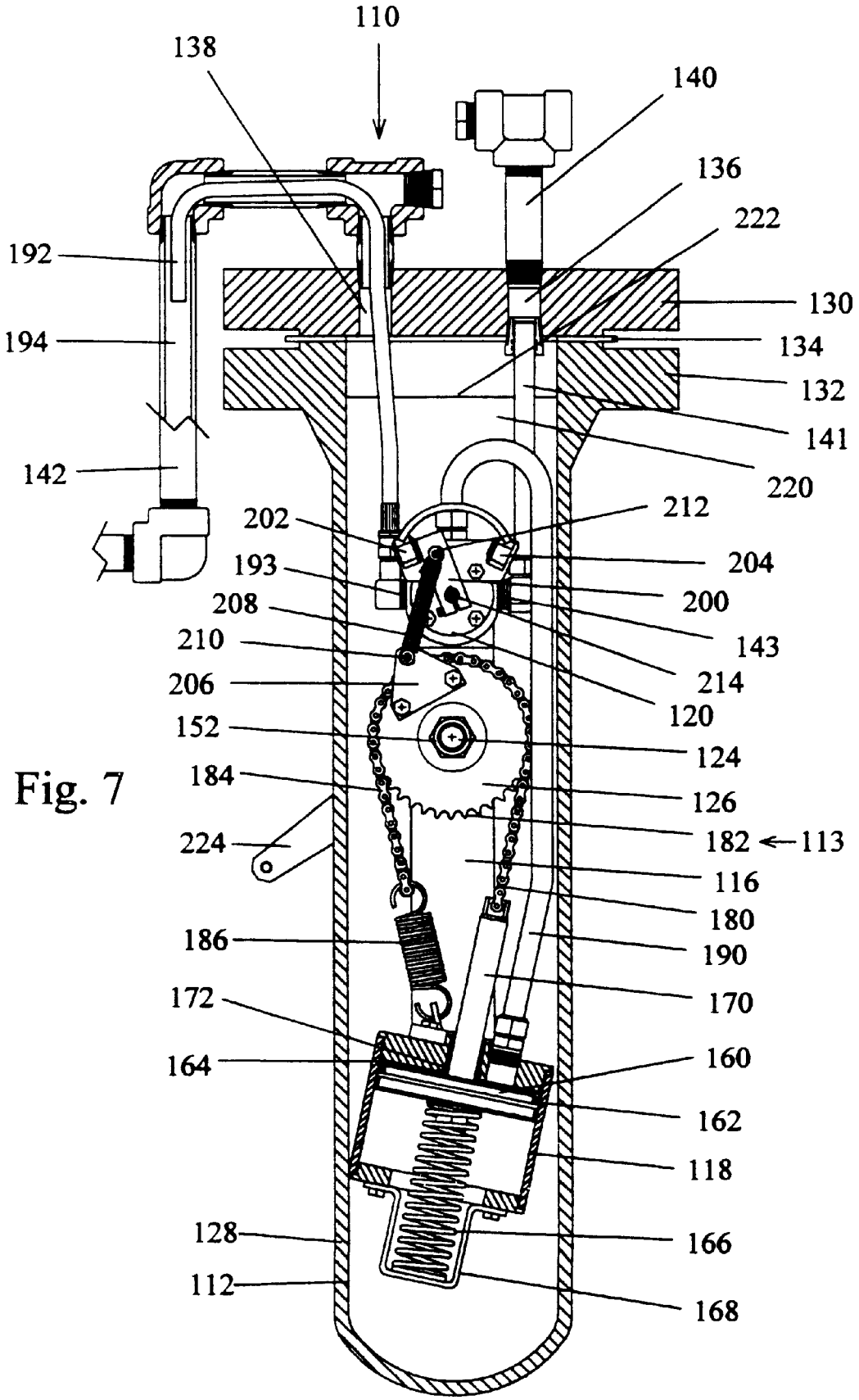
FIG. 7 is an elevation view of one embodiment of the invention, with parts of the pressure vessel wall, the pneumatic cylinder and the outlet pipe, cut away, showing the piston at top of stroke.
Figure 8:
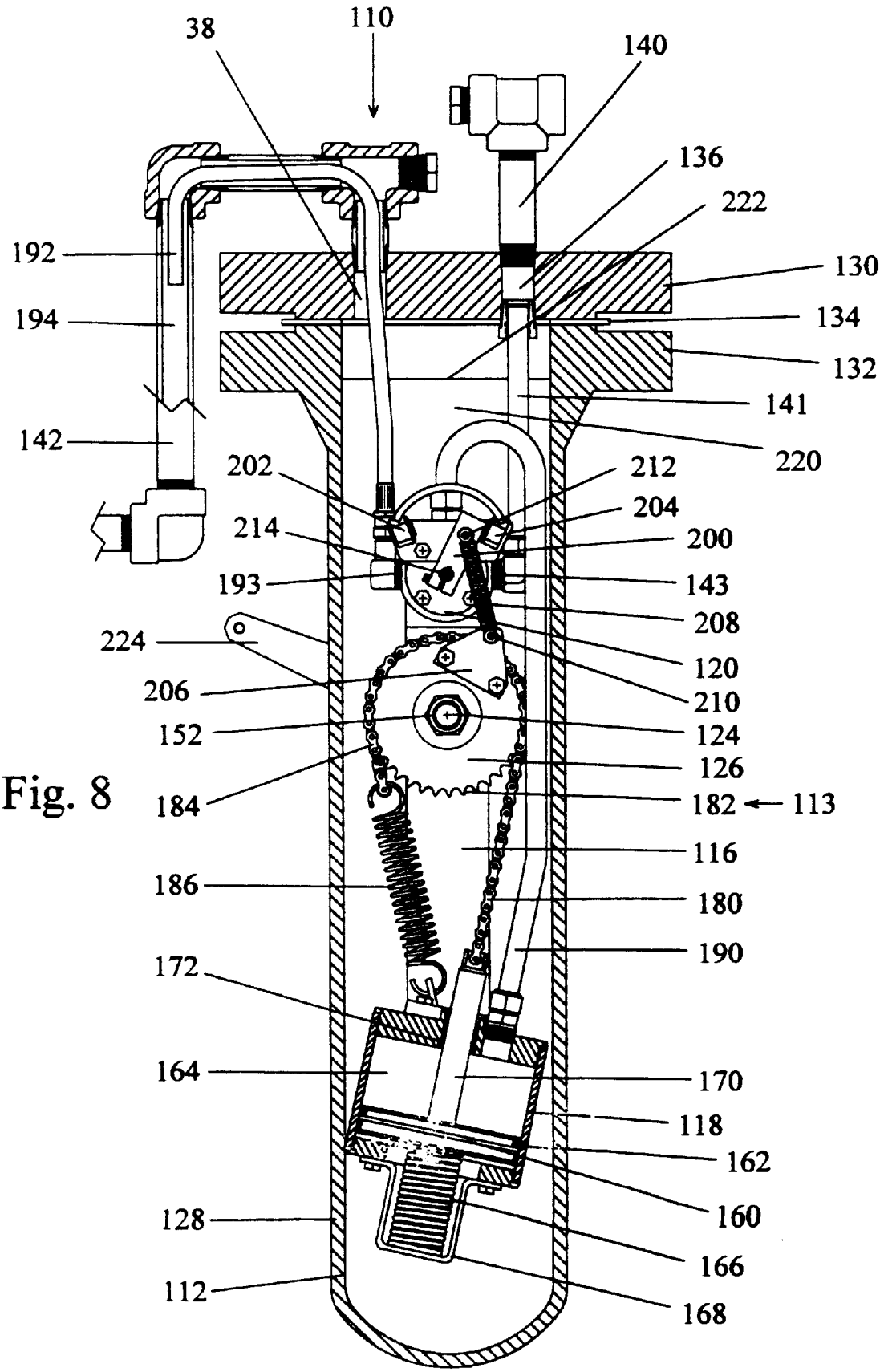
FIG. 8 is the same view as FIG. 7, showing the piston at bottom of stroke.
Figure 9:
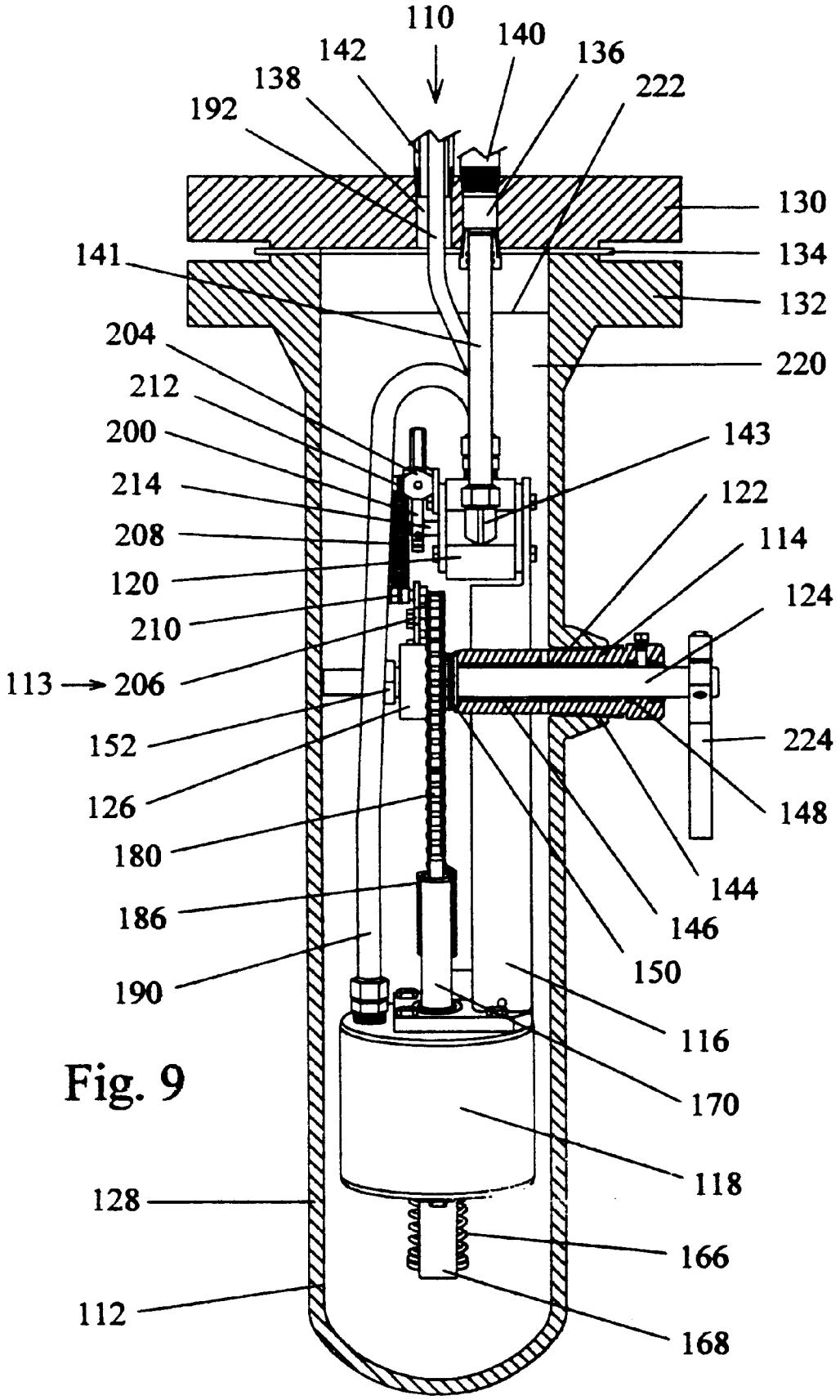
FIG. 9 is an elevation view of the side of the embodiment shown in FIGS. 7 and 8, with the pressure vessel wall, the trunnion and part of the outlet pipe, cut away, showing the piston at top of stroke.

A further embodiment of the invention is shown in FIGS. 7, 8 and 9. The pneumatic apparatus (110) comprises a pressure vessel (112) containing a pneumatic device (113). A trunnion (114) is attached to, and passing through, the side of the pressure vessel (112). The components of the pneumatic device include a main bracket (116), a pneumatic cylinder (118), a Y valve (120) and a drive sprocket (126). The pneumatic cylinder (118) and Y valve (120) are mounted on the main bracket (116). The trunnion (114) passes through, and is attached to, the main bracket (116). The trunnion (114) has a trunnion bore (122) in which the output shaft (124) is disposed. The drive sprocket (126) is concentrically mounted on the output shaft (124).

In the embodiment shown in FIGS. 7, 8 and 9, the pressure vessel (112) comprises the body (128) and the blind flange (130). The body (128) has a body flange (132) to which the blind flange (130) is bolted (bolts not shown) when the apparatus is in use. A gasket (134) is positioned between the blind flange (130) and the body flange (132). The blind flange (130) has a gas inlet (136) and a gas outlet (138). It will be clear to persons skilled in the art that the pressure vessel (112) can take many different forms.

The gas inlet (136) is a port through the blind flange (130). On the top of the blind flange (130), the gas inlet (136) is, when in use, connected by suitable conduit, the inlet pipe (140), to the relatively higher pressure area in a compressed gas system. In the interior of the pressure vessel (112), the gas inlet (136) is connected by the inlet conduit (141) to the pneumatic device intake (143) on the Y valve (120). The gas outlet (138) is a port through the blind flange (130). On the top of the blind flange (130), the gas outlet (138) is, when in use, connected by suitable conduit, the outlet pipe (142), to the relatively lower pressure area in a compressed gas system. In this way, the interior of the pressure vessel (112) is in fluid contact with the relatively lower pressure area in the compressed gas system and is therefore at substantially the same pressure. The inlet pipe (140) and the outlet pipe (142) are typically metal pipe. In FIGS. 7, 8 and 9, screwed pipe is shown.

As shown in FIG. 9, the trunnion (114) is screwed into a threaded trunnion port (144). The trunnion (114) contains two bushings (146) within which the output shaft (124) rotates. The bushings (146) must be made of a material which will not, under the normal working pressure in the interior of the pressure vessel (112), absorb gas or liquid so as to swell and bind between the trunnion (114) and the output shaft (124). Bushings made of polyetheretherketone are suitable for working pressures of at least 1,000 pounds per square inch. Output shaft seals (148) are disposed within the trunnion (114) and around the output shaft (124). The output shaft seals (148) stop gas from leaking from the pressure vessel (112) between the trunnion (114) and the output shaft (124), while permitting the output shaft (124) to rotate. Commercially-available, urethane-based, hydraulic ram seals are suitable for the output shaft seals (148).

The drive sprocket (126) has a concentric bore (not shown) sized to slide over the output shaft (124). The concentric bore of the drive sprocket (126) and the exterior of the output shaft (124) each have a key way (not shown). A key (not shown) is inserted into the key way to prevent the drive sprocket (126) and output shaft (124) from rotating relative to each other. A set screw (not shown) in the hub of the drive sprocket (126) is used to prevent the drive sprocket (126) from moving lengthwise on the output shaft (124). In use, the pressure in the interior of the pressure vessel (112) may be several hundred pounds per square inch greater than the exterior ambient air pressure. Pressure differentials of this magnitude will result in a force of several hundred pounds tending to push the output shaft (124) out of the pressure vessel (112). To deal with this force, one end of the bore in the drive sprocket (126) has a circumferential counter bore (not shown), and the output shaft (124) has a circumferential groove (not shown). The counter bore and groove are sized and positioned to contain a split ring (not shown), wherein the split ring is positioned in the groove and the drive sprocket (126) is slid into position on the output shaft (124) and fixed in position with the set screw so as to retain the split ring. A thrust bearing (150) is disposed between the trunnion (114) and the drive sprocket (126). In this way, the force pushing the output shaft (124) out of the pressure vessel (112) bears against the split ring. In addition, a safety nut (152) is threaded on to the output shaft (124) in case the thrust bearing (150) and split ring fail.

The pneumatic cylinder (118) contains a piston (160). The piston (160) has a piston seal (162) around its periphery which abuts the interior of the pneumatic cylinder (118) through the full range of movement of the piston (160). The piston seal (162) acts to seal the chamber (164) defined by the piston (160) and the pneumatic cylinder (118) from the rest of the interior of the pressure vessel (112).

The piston (160) is in contact with the piston spring (166). The piston spring (166) is contained between the piston spring housing (168) and the piston (160). The piston spring (166) is under compression and the piston spring (166) causes the piston (160) to tend to move towards top of stroke, which position of the piston (160) is shown in FIG. 7.

The piston (160) is attached to one end of the ram (170). The ram (170) passes through the ram seal (172) at the end of the pneumatic cylinder (118). The ram seal (172) acts to seal the chamber (164) from the rest of the interior of the pressure vessel (112).

The other end of the ram (170) is connected to one end of the piston chain (180). The other end of the piston chain (180) is circumferentially attached to the drive sprocket (126). The drive sprocket (126) has teeth (182) spaced evenly around its periphery. The links of the piston chain (180) and the teeth (182) are sized to engage with each other. Some portion of the links of the piston chain (180) proximate to the end of the piston chain (180) which is attached to the drive sprocket (126) are engaged with the teeth (182). Movement of the ram (170) away from the drive sprocket (126) will cause the drive sprocket (126) to rotate in a clockwise direction, as the drive sprocket (126) is shown in FIGS. 7 and 8.

A second chain, the return chain (184), is circumferentially attached to the drive sprocket (126). The links of the return chain (184) and the teeth (182) are sized to engage with each other. Some portion of the links of the return chain (184) proximate to the end of the return chain (184) which is attached to the drive sprocket (126) are engaged with the teeth (182). The end of the return chain (184) which is not attached to the drive sprocket (126) is attached to one end of the return spring (186). The other end of the return spring (186) is attached to the exterior of the pneumatic cylinder (118). The return spring (186) is under tension, such that the force exerted by the return spring (186) on the drive sprocket (126) through the return chain (184), causes the drive sprocket (126) to tend to rotate in a counterclockwise direction, as the drive sprocket (126) is shown in FIGS. 7 and 8.

The Y valve (120) is connected to: the inlet conduit (141), the pneumatic cylinder conduit (190) and the exhaust area conduit (192). The inlet conduit (141) connects the pneumatic device intake (143) to the gas inlet (136). The inlet conduit (141) is typically metal tubing. The pneumatic cylinder conduit (190) connects the Y valve (120) to the chamber (164). The pneumatic cylinder conduit (190) is typically metal tubing.

The exhaust area conduit (192) connects the pneumatic device exhaust (193) on the Y valve (120) to the exhaust area (194). In use, exhaust area (194) is an area which is in fluid communication with the relatively lower pressure portion of the compressed gas system. In FIGS. 7, 8 and 9, the exhaust area (194) is within the outlet pipe (142). This configuration prevents any liquids which might be mixed with the compressed gas from being deposited within the pressure vessel (112). If there is no concern about liquids or other matter being deposited in the pressure vessel (112), the exhaust area (194) can be within the pressure vessel (112). If the exhaust area is within the outlet pipe (142), the exhaust area conduit (192) is typically flexible tubing to facilitate fitting it within the outlet pipe (142). If the exhaust area (194)is within the pressure vessel (112), the exhaust area conduit (192) is typically rigid tubing.

The Y valve (120) is actuated by moving the valve switch (200) between the left stop (202) and the right stop (204). As with the directions of rotation of the drive sprocket (126), "left" and "right" are used solely for convenience in explaining the parts of the invention as shown in the views in FIGS. 7 and 8. When the valve switch (200) is proximate to the left stop (202), gas can flow from the gas inlet (136), through the Y valve (120) and into the chamber (164). When the valve switch (200) is proximate to the right stop (204), gas can flow from the chamber (164), through the Y valve (120) and to the exhaust area (194).

The valve switch (200) is controlled by the switch operator (206). The switch operator (206) is attached to the side of the drive sprocket (126) adjacent to the Y valve (120). The switch operator (206) is connected to one end of the switch spring (208) at the operator pin (210). The valve switch (200) is connected to the other end of the switch spring (208) at the switch pin (212). The switch spring (208) is under tension. As is apparent in FIGS. 7 and 8, the position which the operator pin (210) must be in for the switch operator (206) to move the valve switch (200), is defined by a line passing through the center of the switch pin (212) and the center of the switch pivot (214). For example, if, as shown in FIG. 7, the operator pin (210) is to the left of the line defined by the switch pin (212) and the switch pivot (214), and the valve switch (200) is against the left stop (202), then the switch operator (206) will not exert a rightward pull on the valve switch (200) until the operator pin (210) is to the right of the line defined by the switch pin (212) and the switch pivot (214), at which time the operator pin (210) will be in position to pull the valve switch (200) against the right stop (204). It is clear that the same applies to the reverse motion of the switch operator (206) and valve switch (200). In this way, a reciprocal motion of the drive sprocket (126) causes the Y valve (120) to be positively switched from one position to another.

Typically, the pressure vessel (112) is filled with sufficient oil (220) such that substantially all of the components contained in the pressure vessel (112) are below the top of oil (222) and are submerged in the oil (220). A dipstick assembly (not shown), comprising a threaded port in the top of the pressure vessel (112); a threaded plug rated for the working pressure of the apparatus; and a marked rod attached to the threaded plug, may be installed to monitor the level of the oil (220) within the pressure vessel (112).

In use, as described above, the gas inlet (136) is connected by suitable conduit to a relatively higher pressure area in a compressed gas system, and the gas outlet (138) is connected by suitable conduit to a relatively lower pressure area in the compressed gas system. The pressure differential between the higher pressure and lower pressure gas, drives the piston (160) in the power stroke, being from top of stroke to bottom of stroke, and the piston spring (166) and the return spring (186) drive the piston (160) in the exhaust stroke, being from bottom of stroke to top of stroke.

FIG. 7 shows the position of the various components just after the end of the exhaust stroke: the piston (160) is at top of stroke; the drive sprocket (126) has been rotated counterclockwise by the force exerted by the return spring (186); and the switch operator (206) has pulled the valve switch (200) against the left stop (202), thereby permitting gas to flow from the gas inlet (136) to the chamber (164). As the relatively higher pressure compressed gas flows into the chamber (164), the pressure within the chamber (164) increases until it is greater than the pressure on the other side of the piston (160), which results in a force against the piston (160). Movement of the piston (160) is resisted by a variety of factors, including: the resistence of the piston spring (166) and the return spring (186); friction; and the resistence of the device which the pneumatic apparatus (110) is driving. When the force against the piston (160) exceeds this resistence the piston (160) begins to move towards bottom of stroke, compressing the piston spring (166) and stretching the chain spring (186).

When the piston (160) reaches bottom of stroke, FIG. 8, the piston chain (180) has rotated the drive sprocket (126) such that the operator pin (210) has moved sufficiently so that the valve switch (200) has been pulled against the right stop (204). In this position, the Y valve (120) permits gas to flow from the chamber (164) to the exhaust area (194). The pressure within the chamber (164) equalizes with the pressure in the exhaust area (194), which is substantially the same as the pressure within the pressure vessel (112) and in the lower pressure portion of the gas system. As the pressure in the chamber (164) drops, the force against the piston (160), resulting from the difference in pressure on either side of the piston (160) decreases to a point where it is less than the force applied by the piston spring (166) and the return spring (186), and the piston (160) begins to move toward top of stroke. As the piston (160) reaches top of stroke, the switch operator (206) will pull the valve switch (200) to the left stop (202), the components of the apparatus will once again be in the position shown in FIG. 7, and the cycle will repeat itself.

In this way, each cycle of the piston (160), from top of stroke, FIG. 7, to bottom of stroke, FIG. 8, and back again, FIG. 7, causes the drive sprocket (126) and the output shaft (124) to rotate first in one direction and then in the other direction. As will be obvious to those skilled in the art, the output shaft (124) can be used to drive a variety of mechanical devices in a variety of different ways, including, but not limited to: attaching a crank (224) to the shaft as shown in FIGS. 7, 8 and 9; and by converting the oscillating rotary motion of the output shaft (124) to non-oscillating rotary motion by means of a ratchet slip clutch and flywheel (not shown).

The foregoing is a description of a preferred embodiment of the invention which is given here by way of example. The invention is not to be taken as limited to any of the specific features as described, but comprehends all such variations thereof as come within the scope of the appended claims.

What is claimed is:

1. A pneumatic apparatus for using the pressure differential between an area of higher pressure and an area of lower pressure in a compressed gas system to drive equipment, the pneumatic apparatus comprising:

(A) a pressure vessel;

(B) a gas outlet in the wall of the pressure vessel, said gas outlet being in fluid communication with the interior of the pressure vessel;

(C) a pneumatic device, a portion of said pneumatic device being located within the pressure vessel, and said pneumatic device including an intake and an exhaust, wherein when the pneumatic device is being pneumatically actuated, the gas used to drive the pneumatic device passes into the pneumatic device through the intake and the exhaust gas is exhausted through the exhaust; and (D) said pneumatic device exhaust being in fluid communication with the interior of the pressure vessel;

wherein if the gas outlet is connected by suitable conduit to the area of lower pressure whereby the interior of the pressure vessel is in fluid contact with the area of lower pressure and the pneumatic device intake is connected by suitable conduit to the area of higher pressure whereby the pneumatic device intake is in fluid contact with the area of higher pressure, then exhaust gas from the pneumatic device can flow to the area of lower pressure.

2. The pneumatic apparatus of claim 1 wherein a portion of the equipment driven by the pneumatic apparatus is located within the pressure vessel.

3. The pneumatic apparatus of claim 1 wherein the equipment driven by the pneumatic apparatus is located outside the pressure vessel.

4. The pneumatic apparatus of claim 1 wherein the pneumatic device comprises:

(A) a pneumatic cylinder;

(B) a piston within the pneumatic cylinder, said piston defining a chamber with the pneumatic cylinder, said chamber changing in size as the piston moves within the pneumatic cylinder;

(C) a piston biassing means connected to the piston and causing the piston to tend to move to, and remain at, top of stroke, being the position of the piston where the chamber is the smallest; and (D) a three-port Y valve, wherein one port is connected by conduit to the chamber; one port is the pneumatic device intake and one port is the pneumatic device exhaust;

(E) a valve switch incorporated in the Y valve wherein when the valve switch is at a first position, gas can flow through the Y valve between the intake and the chamber, and when the valve switch is at a second position gas can flow through the Y valve between the chamber and the exhaust; and (F) a linkage connecting the piston to the valve switch, wherein when the piston is substantially at top of stroke the valve switch is at the first position and when the piston is substantially at bottom of stroke the valve switch is at the second position, whereby when the piston is at top of stroke, gas can flow from the intake to the chamber and when the piston is at bottom of stroke, gas can flow from the chamber to the exhaust.

5. The pneumatic apparatus of claim 4 wherein the linkage comprises:

(A) a rotatable member;

(B) a flexible member connected to the piston and attached to the rotatable member, whereby movement of the piston in the direction from top of stroke to bottom of stroke will cause the rotatable member to rotate in one direction;

(C) a rotatable member biassing means connected to the rotatable member and tending to cause the rotatable member to rotate in the opposite direction from that rotation caused by the movement of the piston in the direction from top of stroke to bottom of stroke; and (D) means for connecting the rotatable member to the valve switch.

6. The pneumatic apparatus of claim 5 wherein the rotatable member is attached to an output shaft.

7. The pneumatic apparatus of claim 6 wherein the output shaft passes through the wall of the pressure vessel.

8. The pneumatic apparatus of claim 5 wherein the rotatable member is a sprocket, said sprocket incorporating teeth, and the flexible member is a chain, wherein the chain engages with the teeth.

9. The pneumatic apparatus of claim 8 wherein the rotable member biassing means comprises a spring, one end of the spring being connected to the drive sprocket.

10. The pneumatic apparatus of claim 5 wherein the means for connecting the rotatable member to the valve switch comprises a switch spring.

11. The pneumatic apparatus of claim 1 wherein the pressure vessel contains a liquid.

12. The pneumatic apparatus of claim 11 wherein the liquid is oil.

13. A pneumatic apparatus for using the pressure differential between an area of higher pressure and an area of lower pressure in a compressed gas system to drive equipment, the pneumatic apparatus comprising:

(A) a pressure vessel; and (B) a pneumatic device, a portion of said pneumatic device being located within the pressure vessel, and said pneumatic device incorporating an intake and an exhaust, wherein when the pneumatic device is being pneumatically actuated, the gas used to drive the pneumatic device passes into the pneumatic device through the intake and the exhaust gas is exhausted through the exhaust, and wherein if the pneumatic device exhaust is in fluid communication with the area of lower pressure and the pneumatic device intake is in fluid communication with the area of higher pressure, then exhaust gas from the pneumatic device can flow to the area of lower pressure.

14. The pneumatic apparatus of claim 13 wherein the interior of the pressure vessel is in fluid communication with the pneumatic device exhaust.

15. The pneumatic apparatus of claim 13 wherein the interior of the pressure vessel is in fluid communication with the pneumatic device intake.

* * * * *